US008245606B2

(12) United States Patent
Chiang

(10) Patent No.: US 8,245,606 B2
(45) Date of Patent: Aug. 21, 2012

(54) ADJUSTABLE TORQUE WRENCH HAVING LOCK DEVICE

(75) Inventor: Shui Lai Chiang, Taichung (TW)

(73) Assignee: William Tools Co., Ltd., Taichung Industrial Park, Taichung (TW)

( * ) Notice: Subject to any disclaimer, the term of this patent is extended or adjusted under 35 U.S.C. 154(b) by 396 days.

(21) Appl. No.: 12/590,891

(22) Filed: Nov. 16, 2009

(65) Prior Publication Data

US 2011/0113936 A1 May 19, 2011

(51) Int. Cl.
*B25B 23/143* (2006.01)

(52) U.S. Cl. ..... 81/483; 73/862.21; 81/478

(58) Field of Classification Search ..... 81/478, 81/480–483, 473–476; 73/862.21, 862.23
See application file for complete search history.

(56) References Cited

U.S. PATENT DOCUMENTS 2,934,985 A * 5/1960 Mutolo et al. ..... 81/483
2,959,078 A * 11/1960 Skidmore ..... 81/483
3,581,606 A * 6/1971 Grabovac ..... 81/483
4,248,107 A 2/1981 Blattner
4,541,313 A 9/1985 Wise
4,655,104 A 4/1987 Blattner
4,870,879 A 10/1989 Shieh
6,334,377 B1 1/2002 Wu
6,722,235 B2 * 4/2004 Hsieh ..... 81/478
7,150,212 B2 * 12/2006 Lee ..... 81/475
7,313,974 B2 * 1/2008 Cupif et al. ..... 73/862.21
7,451,674 B2 11/2008 Edgar
7,836,781 B1 * 11/2010 Chen ..... 73/862.22

* cited by examiner

*Primary Examiner* — Debra S Meislin
(74) *Attorney, Agent, or Firm* — Charles E. Baxley

(57) ABSTRACT

An adjustable torque wrench includes a driving shank pivotally coupled to a tubular lever and biased with a compression spring, an adjusting screw for adjusting a compression force of the compression spring, and a barrel attached to the adjusting screw and rotated in concert with the adjusting screw and having a graduation aligned with a window of the tubular lever for allowing the graduation of the barrel to be seen through the window of the tubular lever, a control ferrule is slidably engaged with the adjusting screw for rotating the adjusting screw to adjust the compression force of the compression spring, and a lock device attached to a handle for selectively anchoring the control ferrule to the handle.

12 Claims, 13 Drawing Sheets

ADJUSTABLE TORQUE WRENCH HAVING LOCK DEVICE

BACKGROUND OF THE INVENTION

1. Field of the Invention

The present invention relates to an adjustable torque wrench, and more particularly to an adjustable torque wrench including a lock device for locking the adjustable torque wrench and for preventing the adjustable torque wrench from being easily operated by the other people, and including a displayer device for clearly showing or displaying the torque reading and for allowing the reading to be clearly seen by the users.

2. Description of the Prior Art

Typical adjustable torque wrenches comprise an adjusting screw utilized for the purpose of changing the torque setting of the adjustable torque wrenches.

For example, U.S. Pat. No. 4,248,107 to Blattner discloses one of the typical adjustable torque wrenches comprising a shank pivotally attached or mounted in a lever arm, an adjusting screw fixed to a grip member and rotatable therewith relative to an adjusting nut that is fixed in the lever arm.

However, the typical adjustable torque wrenches have no lock device for locking the adjustable torque wrench and for preventing the adjustable torque wrench from being easily operated by the other people. In addition, the torque value or reading may not be clearly seen or read by the users.

U.S. Pat. No. 4,541,313 to Wise discloses another typical adjustable torque wrench comprising a fixed tube and rotatable coaxial handle which serves to move a nut longitudinally by means of a screw, in order to adjust the compression of a spring, and the torque value is indicated by a scale rotatable in a housing and viewable through a window which includes a cursor.

However, the typical adjustable torque wrenches have no lock device for locking the adjustable torque wrench and for preventing the adjustable torque wrench from being easily operated by the other people. In addition, the torque value or reading may not be clearly seen or read by the users and should be calibrated every time.

U.S. Pat. No. 4,655,104 to Blattner discloses a further typical adjustable torque wrench comprising a slidably interconnected load screw and an adjusting screw positioned within a telescoping lever arm and a handle.

However, similarly, the typical adjustable torque wrenches have no lock device for locking the adjustable torque wrench and for preventing the adjustable torque wrench from being easily operated by the other people. In addition, the torque value or reading may not be clearly seen or read by the users and should be calibrated often.

U.S. Pat. No. 4,870,879 to Shieh discloses a still further typical adjustable torque wrench comprising a ratchet arm pivotally attached or mounted in a flattened portion of a shank, a torque assembly disposed or attached or mounted in a cylindrical portion of the shank.

However, similarly, the typical adjustable torque wrenches have no lock device for locking the adjustable torque wrench and for preventing the adjustable torque wrench from being easily operated by the other people. In addition, the torque value or reading may not be clearly seen or read by the users and should be calibrated often.

U.S. Pat. No. 6,334,377 to Wu discloses a still further typical adjustable torque wrench comprising a driving head having an arm received in a shank, and a follower and a spring received in the shank and guided to move along the shank, and the follower may be moved to adjust the spring force against the arm.

However, similarly, the typical adjustable torque wrenches have no lock device for locking the adjustable torque wrench and for preventing the adjustable torque wrench from being easily operated by the other people. In addition, the torque value or reading may not be clearly seen or read by the users and should be calibrated often.

U.S. Pat. No. 7,451,674 to Edgar discloses a still further typical adjustable torque wrench comprising a drive head that defines a torque transfer axis and that is adapted to transfer torque to a workpiece, the torque wrench includes a tubular handle that is operative, upon rotation relative to a lever, to increase the bias on a spring upon lengthening a distance between the drive head and the opposite end of the handle, and to decrease the bias on the spring upon shortening the distance thereby setting the predetermined operating force.

However, similarly, the typical adjustable torque wrenches have no lock device for locking the adjustable torque wrench and for preventing the adjustable torque wrench from being easily operated by the other people. In addition, the torque value or reading may not be clearly seen or read by the users and should be calibrated often.

The present invention has arisen to mitigate and/or obviate the afore-described disadvantages of the conventional adjustable torque wrenches.

SUMMARY OF THE INVENTION

The primary objective of the present invention is to provide an adjustable torque wrench including a lock device for locking the adjustable torque wrench and for preventing the adjustable torque wrench from being easily operated by the other people.

The other objective of the present invention is to provide an adjustable torque wrench including a displayer device for clearly showing or displaying the torque reading and for allowing the reading to be clearly seen by the users.

In accordance with one aspect of the invention, there is provided an adjustable torque wrench comprising a tubular lever including a chamber formed therein, and including a first end and a second end, and including a lid attached to the second end of the tubular lever, the tubular lever including a window formed therein, a driving shank including a driving head provided on one end and including an inner end portion engaged into the chamber of the tubular lever and including a middle portion pivotally coupled to the first end of the tubular lever with a pivot pin for allowing the driving shank to be pivoted relative to the tubular lever, a roller carrier slidably engaged in the chamber of the tubular lever and pivotally coupled to the inner end portion of the driving shank with a link, at least one roller rotatably attached to the roller carrier and slidably engaged with the tubular lever for guiding the roller carrier to smoothly slide along the tubular lever, a compression spring engaged with the roller carrier for applying a compression force onto the roller carrier and the driving shank, an adjusting screw threaded with the lid of the tubular lever and rotatable and adjustable relative to the lid and the tubular lever for adjusting the adjusting screw longitudinally relative to the tubular lever, the adjusting screw including a first end for engaging with the compression spring and for adjusting the compression force of the compression spring onto the roller carrier when the adjusting screw is threaded and rotated relative to the lid and the tubular lever, and a barrel attached to the adjusting screw and rotated in concert with the adjusting screw, and including a graduation provided on the barrel and aligned with the window of the tubular lever for allowing the graduation of the barrel to be seen through the window of the tubular lever.

The tubular lever includes a gasket engaged between the driving shank and the first end of the tubular lever for sealing the chamber of the tubular lever and for preventing dirt from entering into the chamber of the tubular lever.

The adjusting screw includes a non-circular segment provided on a second end thereof, and a control ferrule includes a non-circular hole formed therein for slidably engaging with the non-circular segment of the adjusting screw and for allowing the adjusting screw to be rotated relative to the lid and the tubular lever with the control ferrule and for allowing the adjusting screw to be adjusted longitudinally relative to the control ferrule in order to adjust the compression force of the compression spring onto the roller carrier.

The control ferrule includes a gear wheel provided thereon, and a handle is attached to the second end of the tubular lever and includes an internal gear for selectively engaging with the gear wheel of the control ferrule and for selectively anchoring the control ferrule and the adjusting screw to the handle and the tubular lever and for preventing the control ferrule and the adjusting screw from being rotated relative to the handle and the tubular lever.

The handle includes a lock device attached thereto for selectively engaging with the gear wheel of the control ferrule and for selectively anchoring the control ferrule to the handle and for preventing the gear wheel of the control ferrule from being disengaged from the internal gear of the handle.

The lock device includes an arm having a middle portion pivotally coupled to the handle with a pivot pin and pivotal or rotatable relative to the handle and having an actuating end extendible through the handle for engaging with the gear wheel of the control ferrule.

The lock device includes a knob attached to the arm for pivoting the arm to selectively disengaging the actuating end of the arm from the gear wheel of the control ferrule. The handle includes a cover having an opening formed therein for rotatably engaging with the knob.

The knob includes at least one depression formed therein, and the cover includes a projection extended therefrom for engaging with the depression of the knob. The knob includes two marks provided thereon for indicating an unlock status and a lock status respectively. The knob includes a non-circular engaging hole formed therein for selectively engaging with a driving tool which may rotate the knob relative to the handle.

The handle includes a shallower seat and a passage formed therein, and the knob includes an extension leg extended therefrom for selectively engaging with either the shallower seat or the passage of the handle.

The knob includes at least one stop provided thereon for engaging with the arm and for selectively anchoring the knob to the handle. The handle includes a lens aligned with the window of the tubular lever for magnifying the graduation of the barrel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
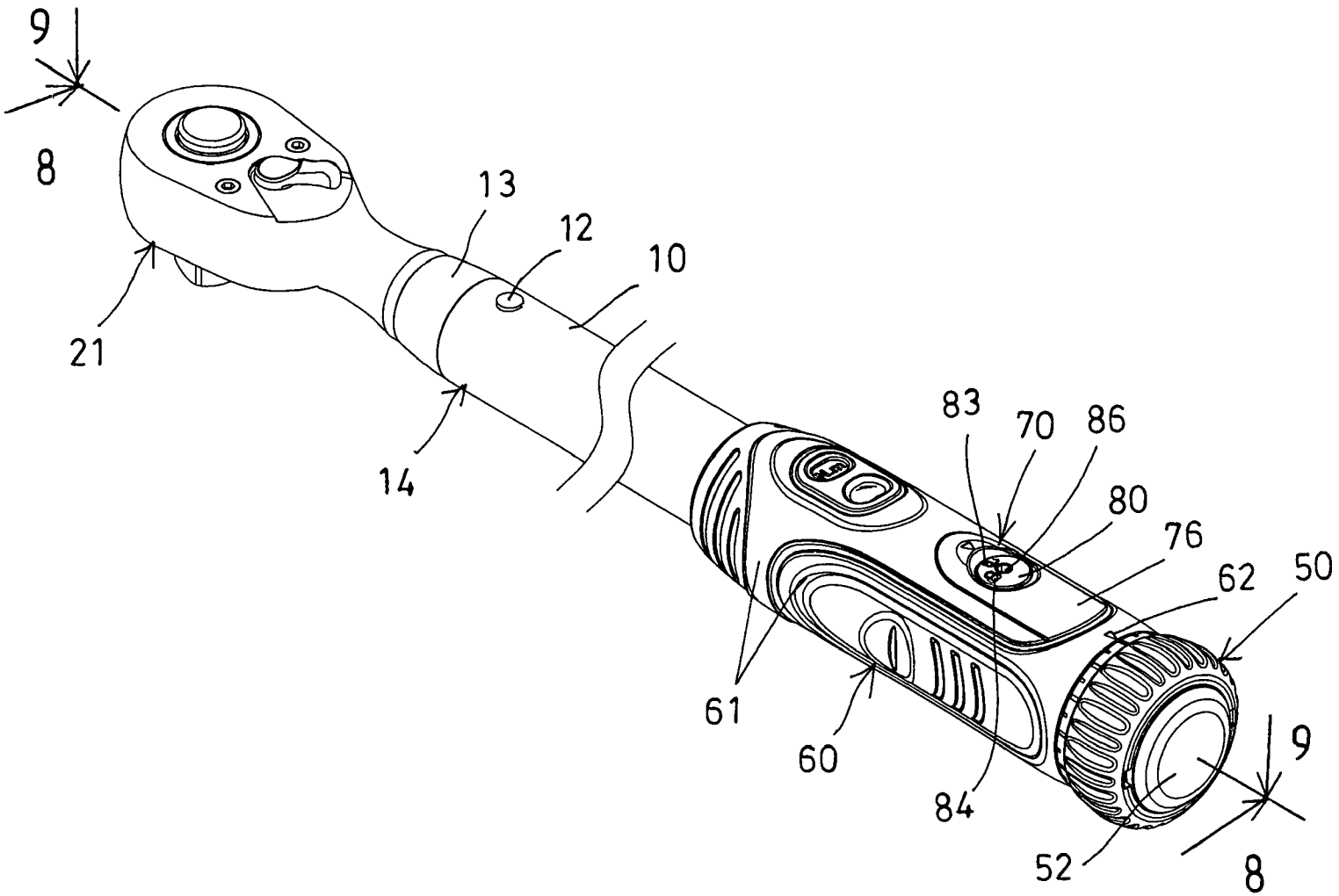
FIG. 1 is a perspective view of an adjustable torque wrench in accordance with the present invention.
Figure 2:
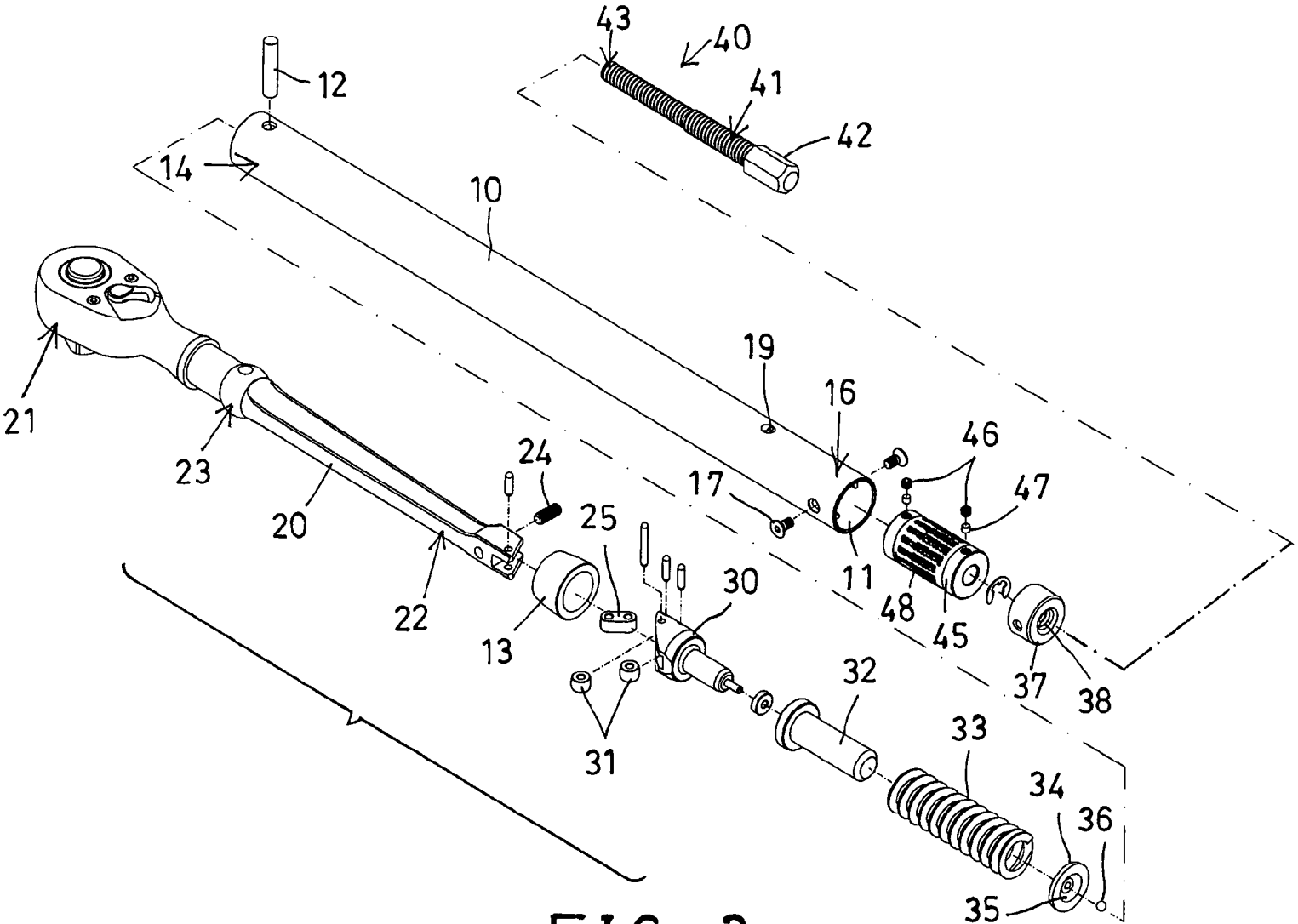
FIG. 2 is a partial exploded view of the adjustable torque wrench.

Referring to the drawings, and initially to FIGS. 1-3 and 8-9, an adjustable torque wrench in accordance with the present invention comprises a tubular lever 10 including a bore or hollow chamber 11 formed therein, and a driving shank 20 including a driving head 21 formed or provided on one end or an outer end portion thereof and including an inner end portion 22 disposed or engaged into the chamber 11 of the tubular lever 10 and including a middle portion 23 rotatably or pivotally coupled to the tubular lever 10 with a pivot pin 12 for allowing the driving shank 20 to be slightly pivoted or rotated relative to the tubular lever 10, and a soft or resilient gasket 13 is preferably provided and engaged between the driving shank 20 and one end 14 of the tubular lever 10 for suitably sealing the chamber 11 of the tubular lever 10 and for preventing the dirt or contaminant from entering into the chamber 11 of the tubular lever 10.

Figure 11:
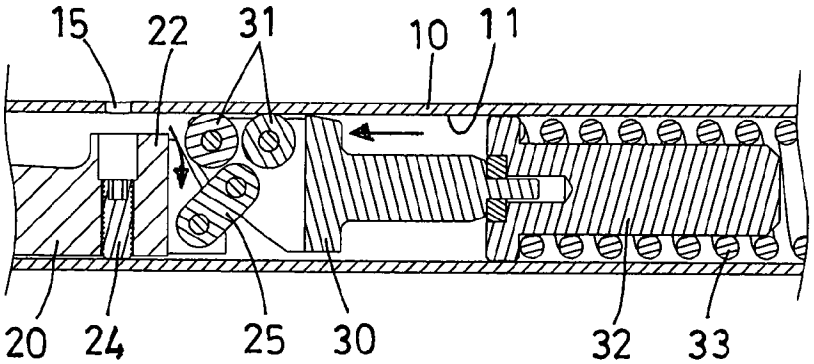
FIGS. 11, 12 are enlarged partial cross sectional views similar to FIG. 9, illustrating the operation of the adjustable torque wrench.
Figure 12:
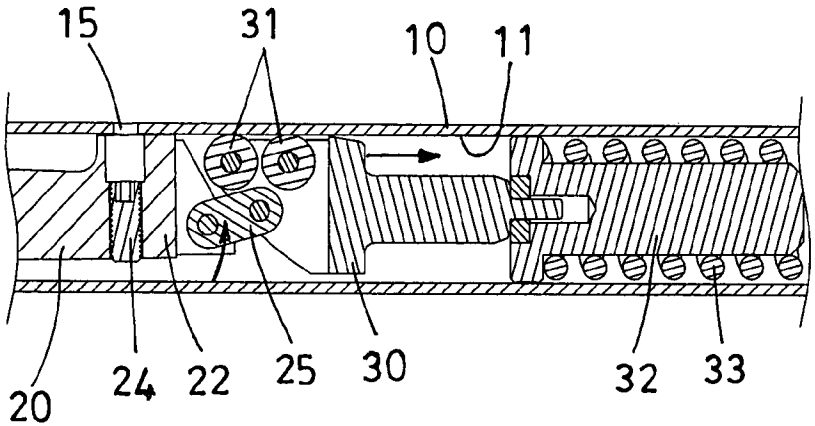

An adjusting screw 24 is threaded or engaged with the inner end portion 22 of the driving shank 20 and extendible out of the driving shank 20 for adjusting the distance or the movement between the inner end portion 22 of the driving shank 20 and the tubular lever 10 and/or for torque value adjusting purpose. The tubular lever 10 includes an orifice 15 formed therein (FIGS. 9, 11, 12) and aligned with the adjusting screw 24 for engaging a driving tool (not shown) through the orifice 15 and into the chamber 11 of the tubular lever 10 and engaged with the adjusting screw 24 for threading or rotating the adjusting screw 24 relative to the driving shank 20 and the tubular lever 10 and for adjusting the distance or the movement of the inner end portion 22 of the driving shank 20 relative to the tubular lever 10.

A roller carrier 30 is slidably received or engaged within the chamber 11 of the tubular lever 10 and pivotally coupled to the inner end portion 22 of the driving shank 20 with a link 25, and one or more (such as two) rollers 31 are rotatably attached or mounted to the roller carrier 30 and slidably and smoothly engaged with the inner peripheral surface of the tubular lever 10 for guiding the roller carrier 30 to smoothly slide or move along the tubular lever 10, a stud 32 is attached or mounted or engaged with the roller carrier 30, and a compression spring 33 is attached or engaged with the stud 32 or directly engaged with the roller carrier 30, and a plate 34 is attached or engaged with the compression spring 33 and includes a depression 35 formed therein for receiving or engaging with a ball 36. A lid 37 is attached or mounted or secured to the other end 16 of the tubular lever 10 with one or more fasteners 17 (FIGS. 2-3, 8, 15-16) and includes a screw hole 38 formed therein.

Another adjusting screw 40 includes an outer thread or threaded portion 41 threaded or engaged with the screw hole 38 of the lid 37 or of the tubular lever 10, and rotatable or adjustable relative to the lid 37 and the tubular lever 10 for adjusting the adjusting screw 40 longitudinally relative or along the tubular lever 10, and includes a non-circular segment 42 formed or provided on one end thereof, and includes the other end 43 engaged with the ball 36 or directly engaged with the compression spring 33 for adjusting the compression force of the compression spring 33 onto or against the stud 32 and/or the roller carrier 30 when the adjusting screw 40 is threaded or rotated relative to the lid 37 and the tubular lever 10. The above-described structure is typical and will not be described in further details.

A barrel 45 is attached or mounted or secured to the adjusting screw 40 with one or more fasteners 46 (FIGS. 2, 15-16) and rotated in concert with the adjusting screw 40, and includes a soft or resilient gasket or pad 47 preferably provided and engaged between each of the fasteners 46 and the threaded portion 41 of the adjusting screw 40, in which the pad 47 may be made of soft copper materials for suitably engaging with the threaded portion 41 of the adjusting screw 40 and for preventing the threaded portion 41 of the adjusting screw 40 from being scrapped or damaged by the fasteners 46. The tubular lever 10 includes one or more (such as two) pathways 18 formed therein (FIGS. 8, 15-16) for selectively aligning with the fasteners 46 and for allowing the fasteners 46 to be rotated or driven by the driving tools (not shown). The barrel 45 includes a number of digits or graduations 48 formed or provided on the outer peripheral portion of the barrel 45, and the tubular lever 10 includes an opening or window 19 formed therein (FIGS. 2, 8) and aligned with the graduation 48 of the barrel 45 for allowing the graduation 48 of the barrel 45 to be seen through the window 19 of the tubular lever 10.

It is to be noted that the typical adjustable torque wrenches failed to provide and attach or mount or secure a barrel 45 to the adjusting screw 40 and rotated in concert with the adjusting screw 40 and failed to provide a graduation 48 on the barrel 45 for allowing the graduation 48 of the barrel 45 to be seen through the window 19 of the tubular lever 10. A control ferrule 50 includes a non-circular hole 51 formed therein for slidably engaging with the non-circular segment 42 of the adjusting screw 40 and for allowing the adjusting screw 40 to be rotated relative to the lid 37 and the tubular lever 10 with the control ferrule 50 and also for allowing the adjusting screw 40 to be slid or moved longitudinally relative to the control ferrule 50, a cap 52 may further be provided and attached or mounted the control ferrule 50 for enclosing or shielding the hole 51 of the control ferrule 50 and for preventing the dirt or contaminant from entering into the hole 51 of the control ferrule 50.

Figure 3:
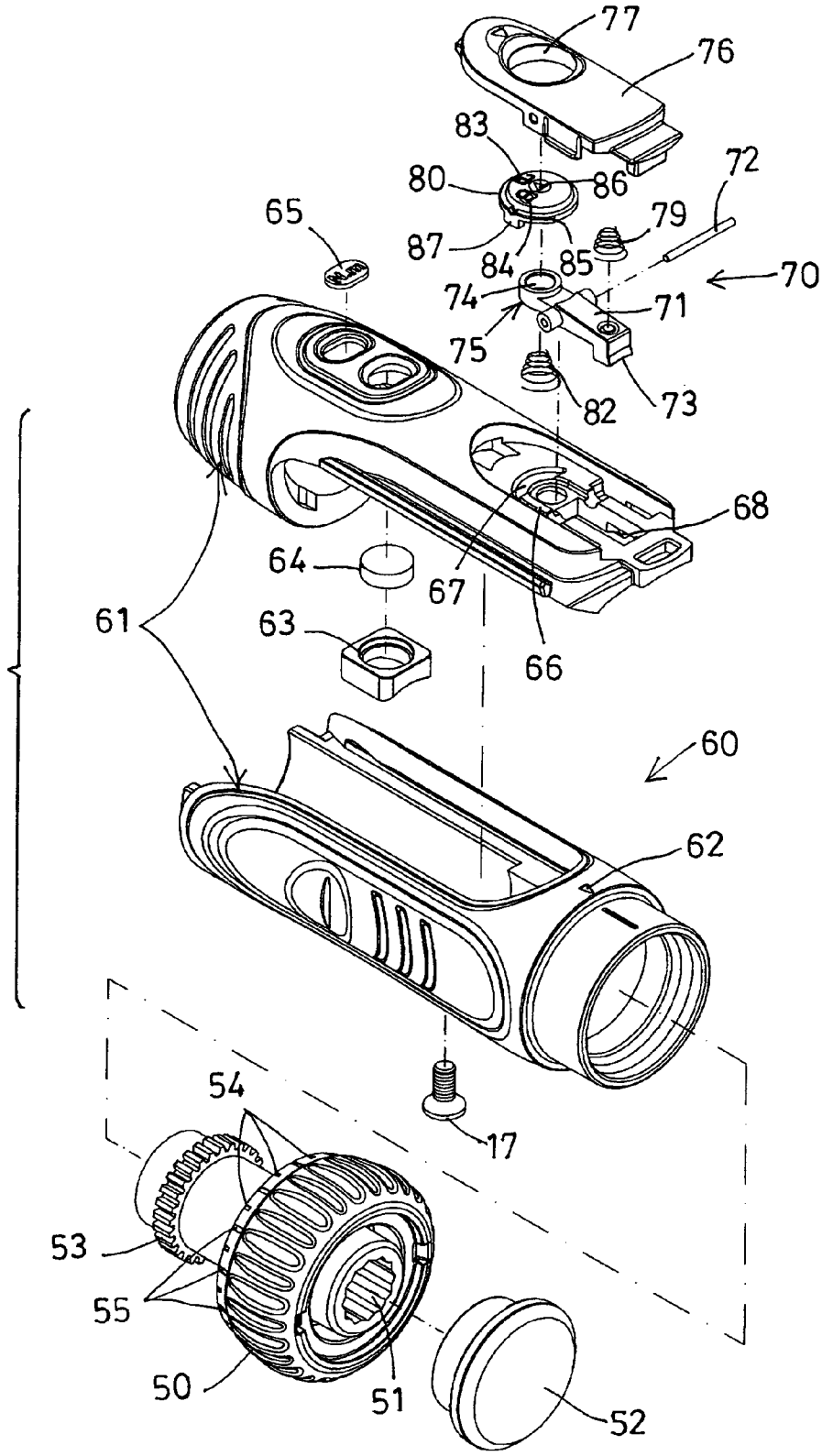
FIG. 3 is another partial exploded view of the adjustable torque wrench.
Figure 13:
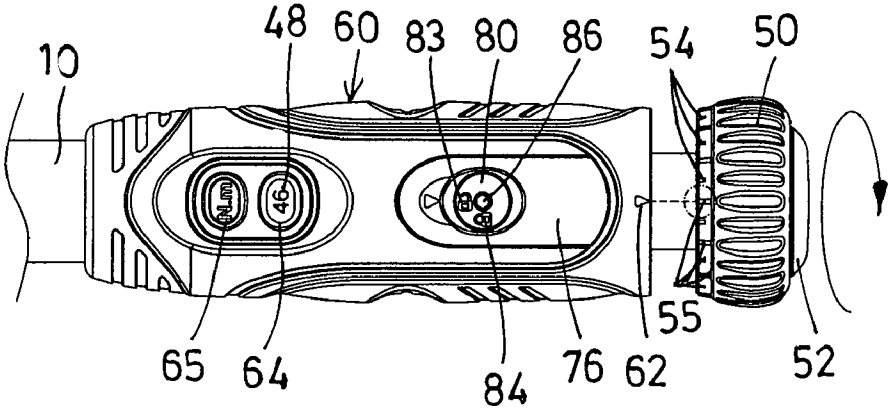
FIGS. 13, 14 are enlarged partial top plan schematic views illustrating the operation of the adjustable torque wrench.
Figure 14:
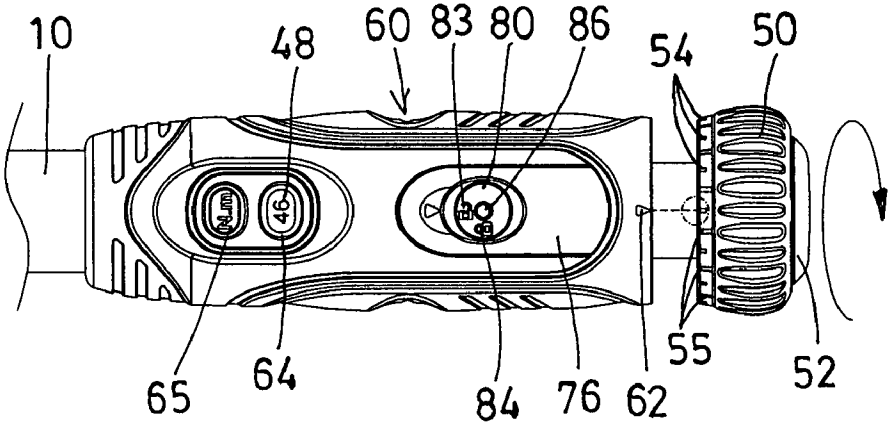
Figure 15:
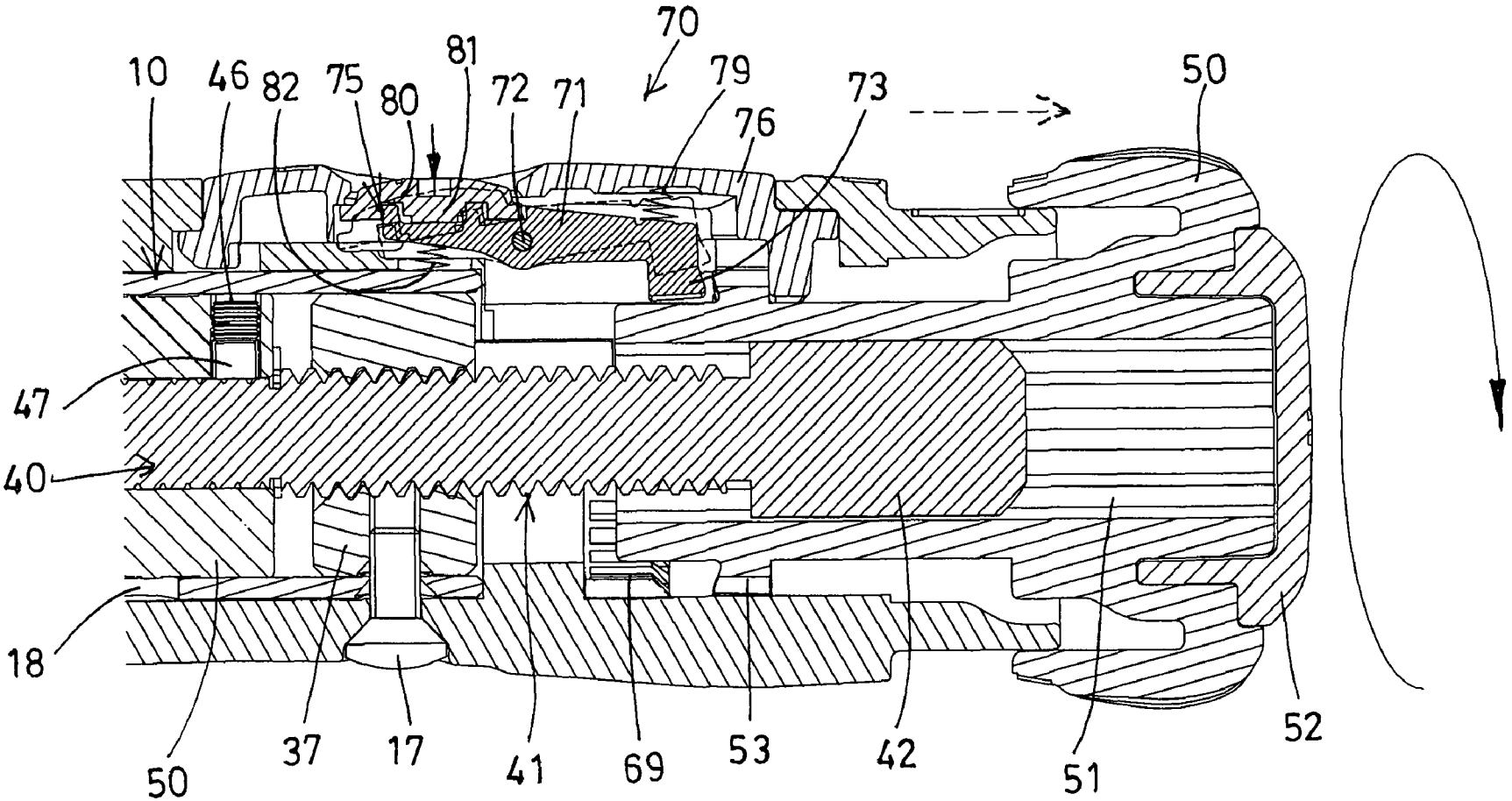
FIGS. 15, 16 are partial cross sectional views similar to FIG. 8, illustrating the operation of the adjustable torque wrench.

In operation, as shown in FIGS. 13-15, the adjusting screw 40 may be rotated relative to the lid 37 and the tubular lever 10 with the control ferrule 50 for sliding or moving the adjusting screw 40 longitudinally relative to the control ferrule 50 and the lid 37 and the tubular lever 10 and for adjusting the relative position between the compression spring 33 and the adjusting screw 40 and thus for adjusting the compression of the compression spring 33 by the adjusting screw 40. The control ferrule 50 includes a gear wheel 53 formed and provided thereon (FIGS. 3, 15-16) and includes a number of shorter scales 54 and longer scales 55 formed and provided thereon and arranged alternatively relative to each other (FIGS. 3, 13-14).

A handle 60 includes such as two handle members 61 attached or mounted or secured to the other end 16 of the tubular lever 10 with such as the fasteners 17 (FIGS. 8, 15-16), and includes a pointer 62 formed or provided on one of the handle members 61 for aligning with either of the scales 54, 55 and for pointing or indicating the torque value or reading, in which the longer scales 55 represent integers and the shorter scales 54 represent 0.5 or one half between the integers, and the handle 60 includes a frame 63 disposed or engaged into one of the handle members 61 for receiving or engaging with a lens 64, in which the lens 64 and the frame 63 are aligned with the window 19 of the tubular lever 10 (FIG. 8) for allowing the graduation 48 of the barrel 45 to be seen through the window 19 of the tubular lever 10 and to be magnified with the lens 64 and thus to be clearly seen by the users.

Figure 5:
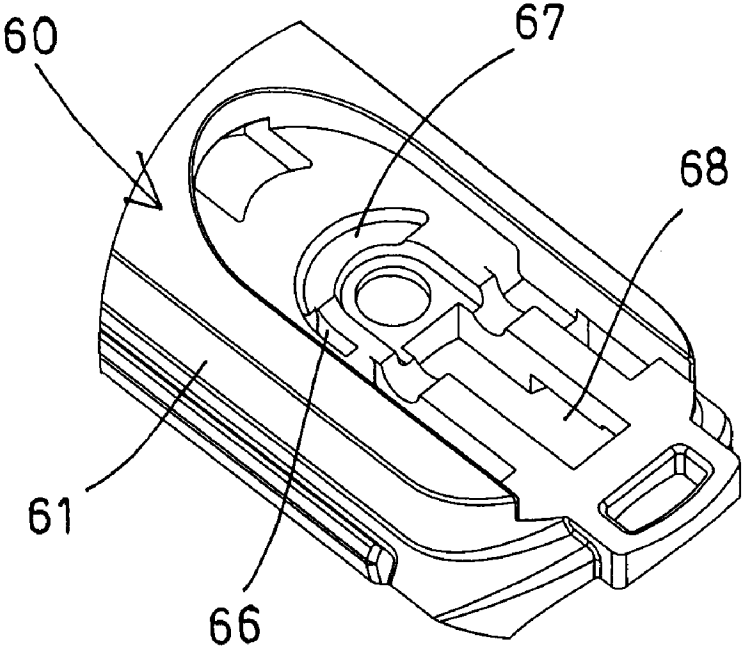
FIG. 5 is another partial perspective view illustrating the other handle member of the adjustable torque wrench.
Figure 4:
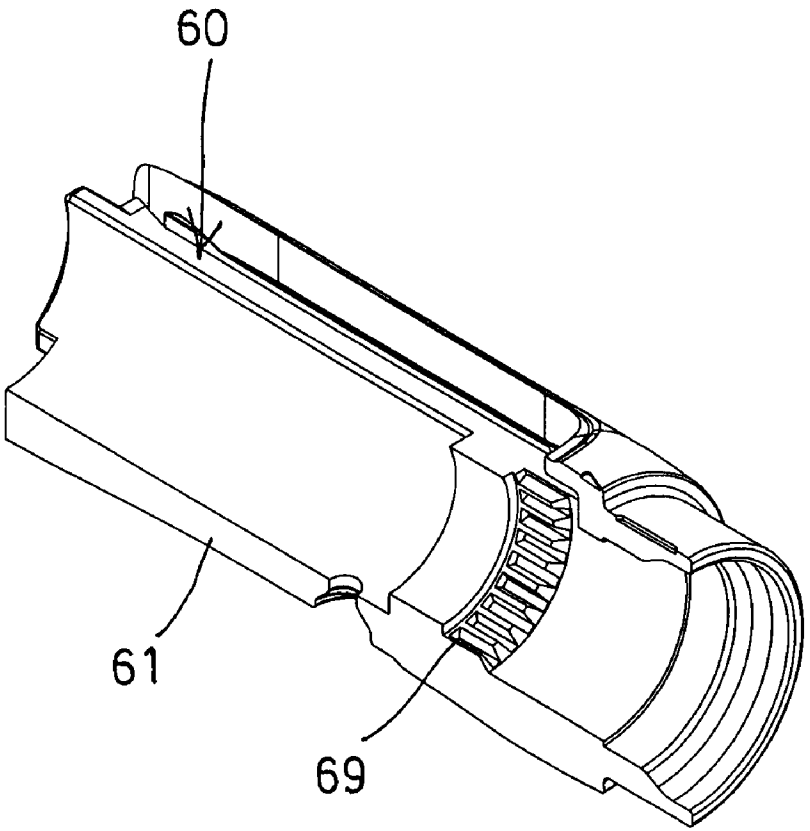
FIG. 4 is a partial perspective view illustrating one of the handle members of the adjustable torque wrench.

The handle 60 further includes a unit tag 65 attached or mounted to one of the handle members 61 for indicating the unit of the torque value or reading, such as the British system of units: lb.ft, or the Metric system: N.m, and includes a shallower shoulder or seat 66 and a deeper passage 67 and a channel 68 formed in one of the handle members 61 (FIGS. 3, 5), and includes an internal gear 69 formed in the other handle members 61 (FIGS. 4, 15-16) for selectively engaging with the gear wheel 53 of the control ferrule 50 (FIG. 16) and for selectively anchoring or positioning the control ferrule 50 and the adjusting screw 40 to the handle 60 and the tubular lever 10 and for preventing the control ferrule 50 and the adjusting screw 40 from being rotated relative to the handle 60 and the tubular lever 10.

The control ferrule 50 and the adjusting screw 40 may be rotated relative to the handle 60 and the tubular lever 10 (FIGS. 13-15) when the control ferrule 50 is pulled rearwardly relative to the handle 60 or away from the handle 60 and the tubular lever 10 and, when the gear wheel 53 of the control ferrule 50 is disengaged from the internal gear 69 of the handle member 61 or of the handle 60, in order to adjust the compression of the compression spring 33 by the adjusting screw 40, the compression spring 33 may apply the compression force onto or against the stud 32 and/or the roller carrier 30 and the driving shank 20 (FIG. 11), and the inner end portion 22 of the driving shank 20 may strike onto the tubular lever 10 (FIG. 12) to generate a click sound when overcome the compression force of the compression spring 33.

As shown in FIGS. 3, 8, and 15-16, a lock device 70 includes an arm 71 having a middle portion pivotally or rotatably attached or mounted or coupled to one of the handle members 61 with a pivot pin 72 and pivotal relative to the handle 60, and the arm 71 includes an actuating end 73 extendible through the channel 68 of the handle member 61 or of the handle 60 for engaging with the gear wheel 53 of the control ferrule 50 (FIGS. 15, 16) and for selectively anchoring or positioning or retaining the gear wheel 53 of the control ferrule 50 in engagement with the internal gear 69 of the handle member 61 or of the handle 60 (FIG. 16) or in disengagement from the internal gear 69 of the handle member 61 or of the handle 60 (FIG. 15). The arm 71 includes an aperture 74 formed in the other end portion 75 thereof.

Figure 6:
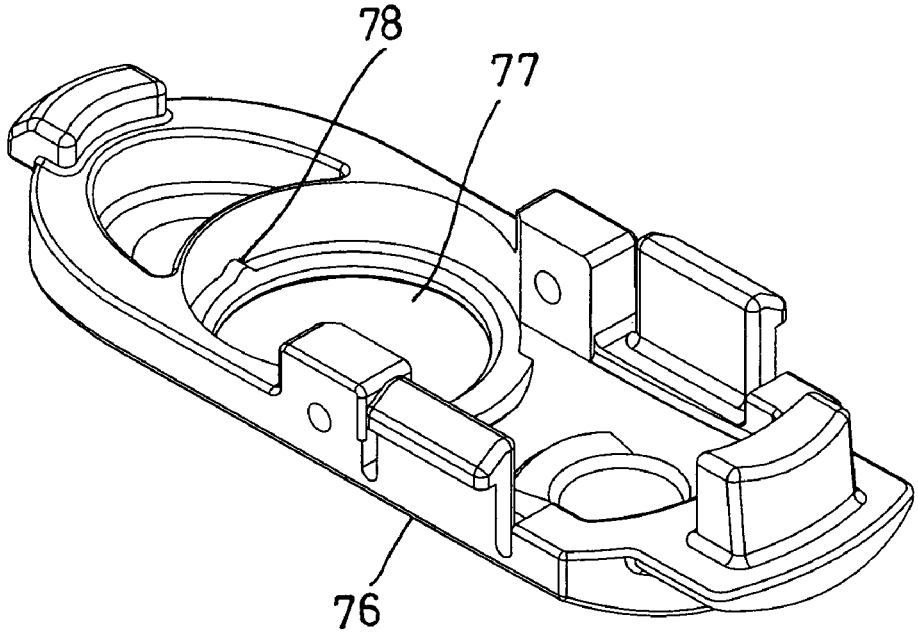
FIGS. 6, 7 are other partial perspective views illustrating the other members of the adjustable torque wrench.
Figure 16:
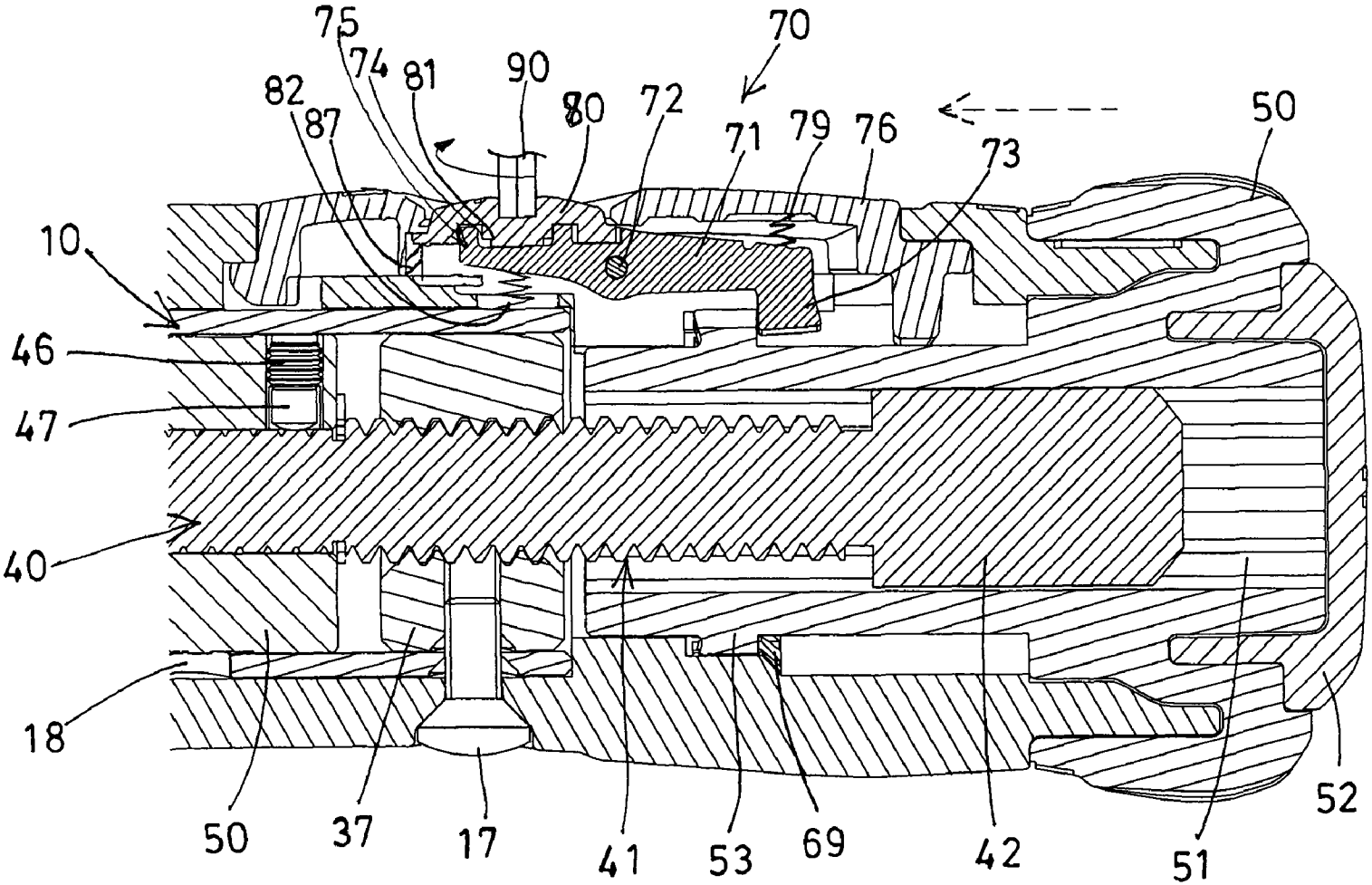
Figure 18:
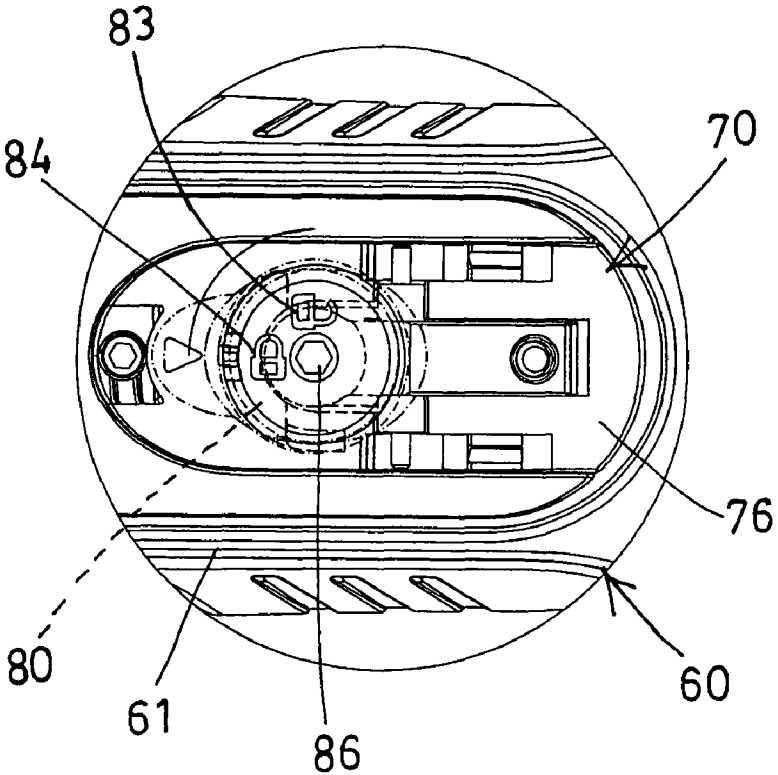
FIGS. 17, 18 are enlarged partial top plan schematic views illustrating the adjustable torque wrench as shown in FIGS. 15 and 17 respectively.
Figure 17:
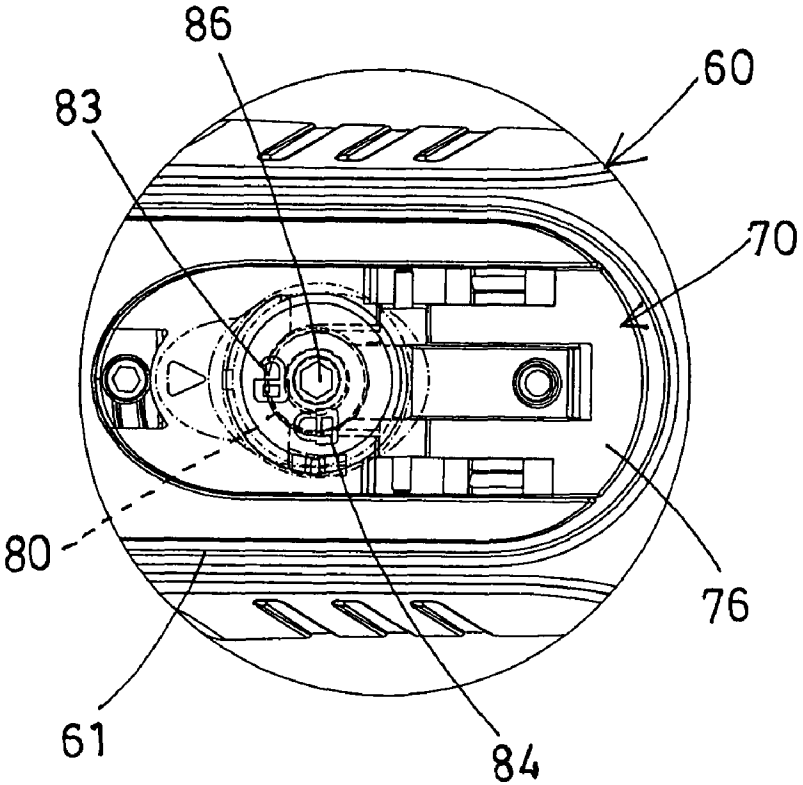

A cover 76 is attached or mounted to one of the handle members 61 of the handle 60, and includes an opening 77 formed therein, and includes a projection 78 extended therefrom and located beside the opening 77 of the cover 76 (FIG. 6), a spring biasing member 79 is provided and disposed or attached or mounted between the cover 76 of the handle 60 and the arm 71 for biasing or forcing the actuating end 73 of the arm 71 to selectively engage with the gear wheel 53 of the control ferrule 50 (FIGS. 15, 16). A button or knob 80 is pivotally or rotatably engaged in the opening 77 of the cover 76 or of the handle 60, and includes a protrusion 81 extended therefrom and pivotally or rotatably engaged in the aperture 74 of the arm 71 for stably anchoring or positioning the knob 80 between the cover 76 and the handle members 61 of the handle 60 and for attaching or securing the knob 80 to the arm 71.

Figure 7:
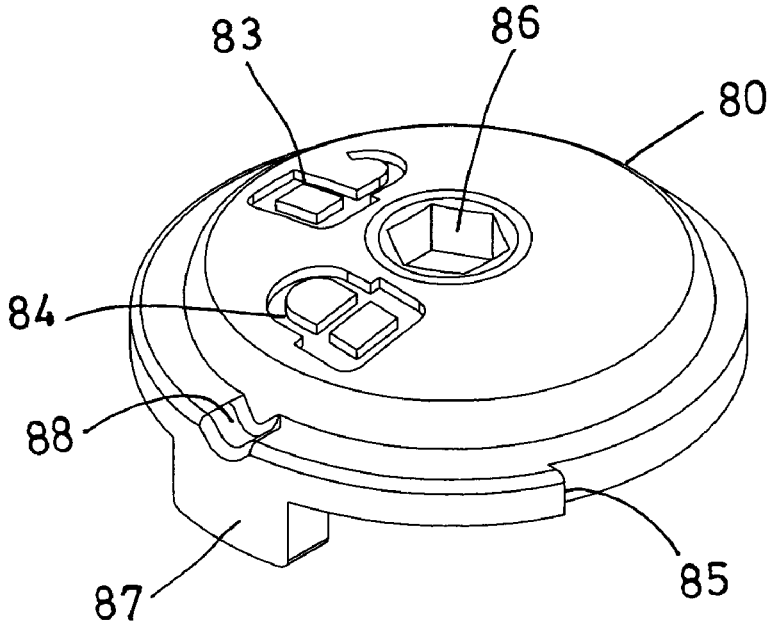
Figure 8:
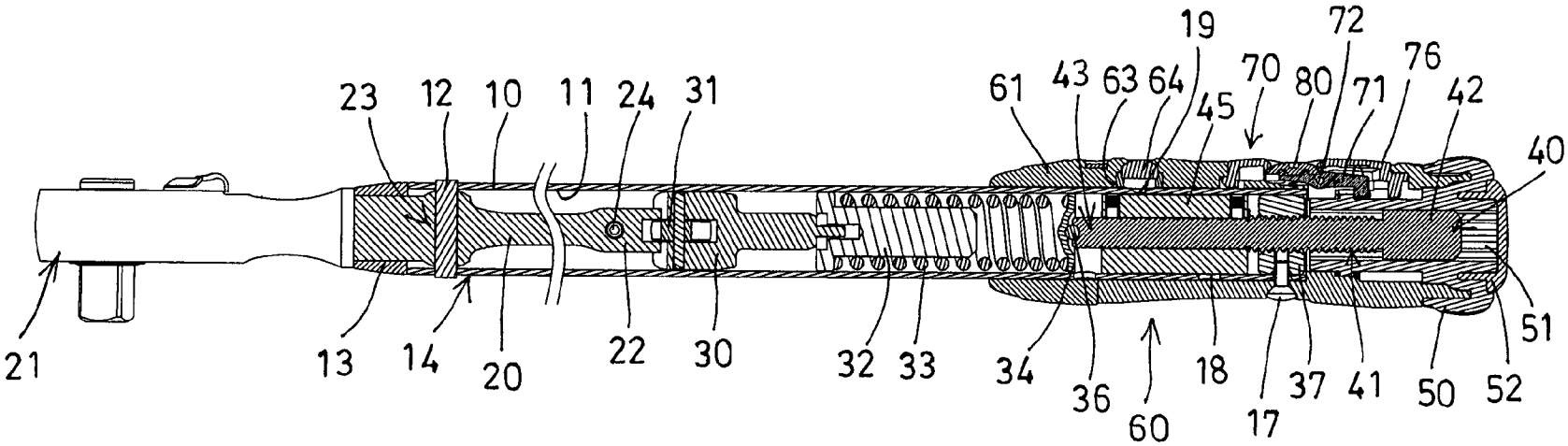
FIGS. 8, 9 are partial cross sectional views of the adjustable torque wrench taken along 8-8 and 9-9 of FIG. 1 respectively.
Figure 9:
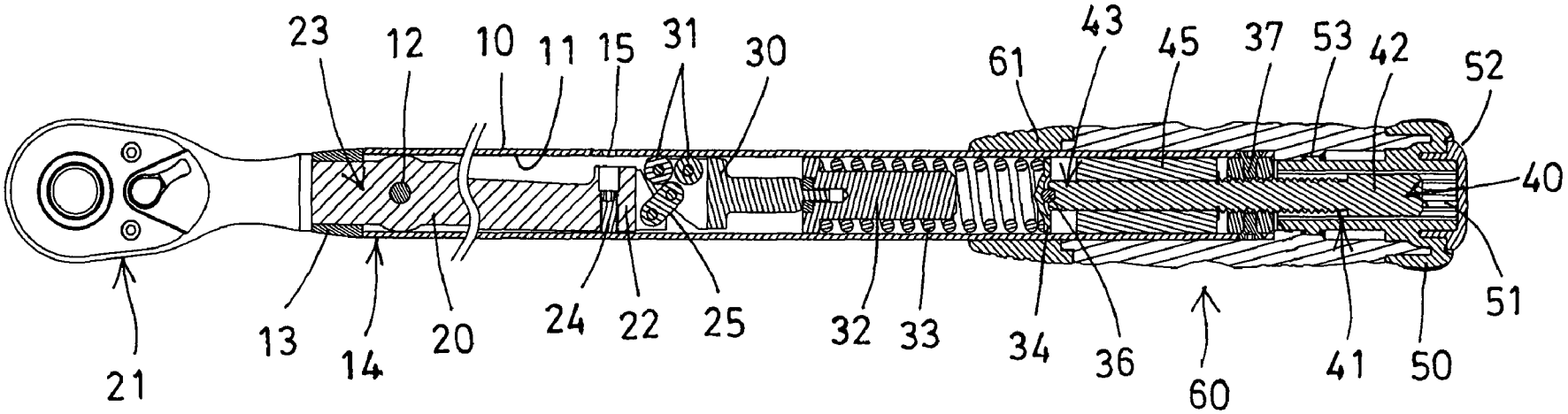
Figure 10:
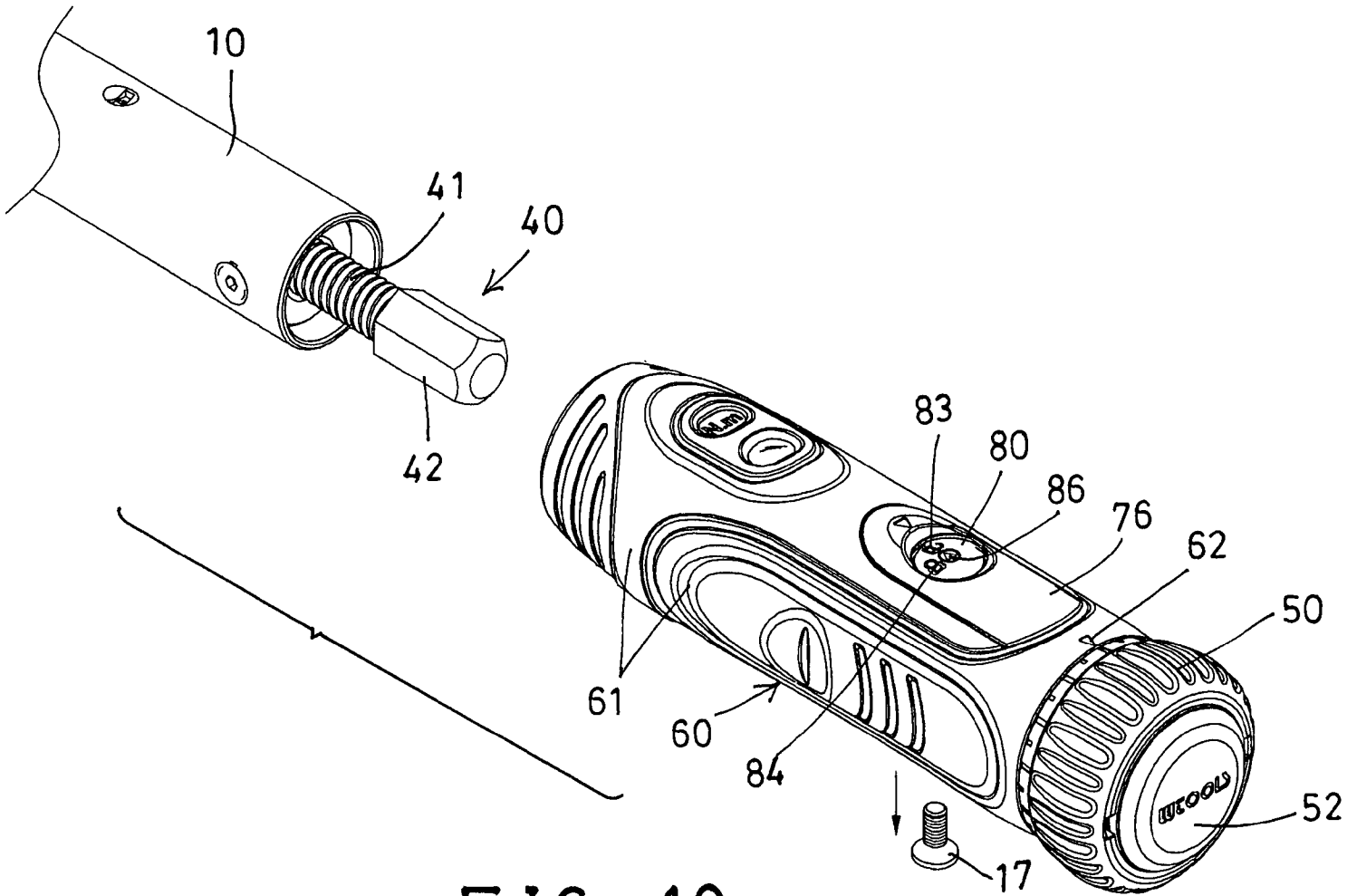
FIG. 10 is a further partial exploded view of the adjustable torque wrench.

Another spring biasing member 82 may further be provided and disposed or attached or mounted between the cover 76 or the knob 80 and the handle members 61 of the handle 60 for biasing or forcing the knob 80 out of the opening 77 of the cover 76 or of the handle 60 (FIG. 16) and for allowing the knob 80 to be depressed or actuated by the users (FIG. 15). The knob 80 may further include two indications or patterns or marks 83, 84 formed or provided thereon (FIGS. 3, 7, 17-18) for indicating the unlock and the lock position or status respectively, and includes one or more (such as two) stops 85 formed or provided thereon (FIGS. 3, 7) for engaging with the arm 71 and for selectively anchoring or positioning the knob 80 to the cover 76 or the handle 60, and for selectively indicating the unlock or the lock position or status.

The knob 80 may further include a non-circular engaging hole 86 formed therein for selectively engaging with a driving tool 90 (FIG. 16) which may rotate the knob 80 between the unlock and the lock position or status, and may further include an extension leg 87 extended therefrom for selectively engaging with either the shallower seat 66 or the passage 67 of the handle 60, for example, as shown in FIG. 15, when the extension leg 87 of the knob 80 is engaged in the passage 67 of the handle 60, the knob 80 and thus the other end portion 75 of the arm 71 may be depressed or actuated by the users to selectively disengage the actuating end 73 of the arm 71 from the gear wheel 53 of the control ferrule 50 and to allow the control ferrule 50 to be pulled rearwardly relative to the handle 60 or away from the handle 60 and the tubular lever 10 and to allow the gear wheel 53 of the control ferrule 50 to be selectively disengaged from the internal gear 69 of the handle member 61 or of the handle 60.

As shown in FIG. 16, when the extension leg 87 of the knob 80 is engaged in the shallower seat 66 of the handle 60, the knob 80 and thus the other end portion 75 of the arm 71 may no longer be depressed or actuated by the users, the actuating end 73 of the arm 71 may be retained in engagement with the gear wheel 53 of the control ferrule 50 and may selectively anchor or position or retain the gear wheel 53 of the control ferrule 50 in engagement with the internal gear 69 of the handle member 61 or of the handle 60 or in disengagement from the internal gear 69 of the handle member 61 or of the handle 60 and for preventing the control ferrule 50 from being pulled rearwardly relative to the handle 60 or away from the handle 60 and the tubular lever 10. The knob 80 may further include one or more (such as two) depressions 88 formed therein (FIG. 7) for selectively engaging with the projection 78 of the cover 76 or of the handle 60 and for selectively maintaining the knob 80 at the unlock or the lock position or status respectively.

Accordingly, the adjustable torque wrench in accordance with the present invention includes a lock device for locking the adjustable torque wrench and for preventing the adjustable torque wrench from being easily operated by the other people, and including a displayer device for clearly showing or displaying the torque reading and for allowing the reading to be clearly seen by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable torque wrench comprising:

a tubular lever including a chamber formed therein, and including a first end and a second end, and including a lid attached to said second end of said tubular lever, said tubular lever including a window formed therein, a driving shank including a driving head provided on one end and including an inner end portion engaged into said chamber of said tubular lever and including a middle portion pivotally coupled to said first end of said tubular lever with a pivot pin for allowing said driving shank to be pivoted relative to said tubular lever, a roller carrier slidably engaged in said chamber of said tubular lever and pivotally coupled to said inner end portion of said driving shank with a link, at least one roller rotatably attached to said roller carrier and slidably engaged with said tubular lever for guiding said roller carrier to smoothly slide along said tubular lever, a compression spring engaged with said roller carrier for applying a compression force onto said roller carrier and said driving shank, an adjusting screw threaded with said lid of said tubular lever and rotatable and adjustable relative to said lid and said tubular lever for adjusting said adjusting screw longitudinally relative to said tubular lever, said adjusting screw including a first end for engaging with said compression spring and for adjusting the compression force of said compression spring onto said roller carrier when said adjusting screw is threaded and rotated relative to said lid and said tubular lever, and said adjusting screw including a non-circular segment provided on a second end thereof, a control ferrule including a non-circular hole formed therein for slidably engaging with said non-circular segment of said adjusting screw and for allowing said adjusting screw to be rotated relative to said lid and said tubular lever with said control ferrule and for allowing said adjusting screw to be adjusted longitudinally relative to said control ferrule to adjust the compression force of said compression spring onto said roller carrier, said control ferrule including a gear wheel provided thereon, a handle attached to said second end of said tubular lever and including an internal gear for selectively engaging with said gear wheel of said control ferrule and for selectively anchoring said control ferrule and said adjusting screw to said handle and said tubular lever and for preventing said control ferrule and said adjusting screw from being rotated relative to said handle and said tubular lever, and a barrel attached to said adjusting screw and rotated in concert with said adjusting screw, and including a graduation provided on said barrel and aligned with said window of said tubular lever for allowing said graduation of said barrel to be seen through said window of said tubular lever.

2. The adjustable torque wrench as claimed in claim 1, wherein said tubular lever includes a gasket engaged between said driving shank and said first end of said tubular lever for sealing said chamber of said tubular lever and for preventing dirt from entering into said chamber of said tubular lever.

3. The adjustable torque wrench as claimed in claim 1, wherein said handle includes a lock device attached thereto for selectively engaging with said gear wheel of said control ferrule and for selectively anchoring said control ferrule to said handle and for preventing said gear wheel of said control ferrule from being disengaged from said internal gear of said handle.

4. The adjustable torque wrench as claimed in claim 3, wherein said lock device includes an arm having a middle portion pivotally coupled to said handle with a pivot pin and pivotal relative to said handle and having an actuating end extendible through said handle for engaging with said gear wheel of said control ferrule.

5. The adjustable torque wrench as claimed in claim 4, wherein said lock device includes a knob attached to said arm for pivoting said arm to selectively disengaging said actuating end of said arm from said gear wheel of said control ferrule.

6. The adjustable torque wrench as claimed in claim 5, wherein said handle includes a cover having an opening formed therein for rotatably engaging with said knob.

7. The adjustable torque wrench as claimed in claim 6, wherein said knob includes at least one depression formed therein, and said cover includes a projection extended therefrom for engaging with said at least one depression of said knob.

8. The adjustable torque wrench as claimed in claim 5, wherein said knob includes two marks provided thereon for indicating an unlock status and a lock status respectively.

9. The adjustable torque wrench as claimed in claim 5, wherein said knob includes a non-circular engaging hole formed therein for selectively engaging with a driving tool.

10. The adjustable torque wrench as claimed in claim 5, wherein said handle includes a shallower seat and a passage formed therein, and said knob includes an extension leg extended therefrom for selectively engaging with either said shallower seat or said passage of said handle.

11. The adjustable torque wrench as claimed in claim 5, wherein said knob includes at least one stop provided thereon for engaging with said arm and for selectively anchoring said knob to said handle.

12. The adjustable torque wrench as claimed in claim 1, wherein said handle includes a lens aligned with the window of the tubular lever for magnifying said graduation of said barrel.

* * * * *